US007163052B2

(12) United States Patent
Taras et al.

(10) Patent No.: US 7,163,052 B2
(45) Date of Patent: Jan. 16, 2007

(54) PARALLEL FLOW EVAPORATOR WITH NON-UNIFORM CHARACTERISTICS

(75) Inventors: Michael F. Taras, Fayetteville, NY (US); Allen C. Kirkwood, Danville, IN (US); Robert A. Chopko, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 134 days.

(21) Appl. No.: 10/988,123

(22) Filed: Nov. 12, 2004

(65) Prior Publication Data

US 2006/0102329 A1 May 18, 2006

(51) Int. Cl.
*F28D 1/053* (2006.01)

(52) U.S. Cl. ..... 165/146; 165/153; 165/173

(58) Field of Classification Search ..... 165/146, 165/151–153, 173, 175
See application file for complete search history.

(56) References Cited

U.S. PATENT DOCUMENTS 1,524,520 A * 1/1925 Junkers ..... 165/146
3,073,575 A * 1/1963 Schulenberg ..... 165/146
3,739,841 A * 6/1973 Small et al. ..... 165/146
3,877,517 A * 4/1975 Pasternak ..... 165/146
4,300,481 A * 11/1981 Fisk ..... 165/174
6,286,588 B1 * 9/2001 Uehara ..... 165/146
2005/0098307 A1 * 5/2005 Goto ..... 165/146

* cited by examiner

*Primary Examiner*—Teresa J. Walberg
(74) *Attorney, Agent, or Firm*—Wall Marjama & Bilinski LLP

(57) ABSTRACT

In a parallel flow heat exchanger, which is susceptible to having a non-uniform distribution of a two-phase refrigerant flow to the individual channels, the resultant differences in the refrigerant flow therethrough are compensated and counter-balanced by a corresponding difference in the external heat transfer rate for the respective channels. In one embodiment, these differences are accomplished by variable characteristics of extended heat transfer surface elements such as fin type, fin density, fin geometry and difference in construction materials, and in another embodiment, by varying the airflow distribution over the cross-section area of the heat exchanger.

18 Claims, 3 Drawing Sheets

PARALLEL FLOW EVAPORATOR WITH NON-UNIFORM CHARACTERISTICS

BACKGROUND OF THE INVENTION

This invention relates generally to air conditioning and refrigeration systems and, more particularly, to parallel flow evaporators thereof.

A definition of a so-called parallel flow heat exchanger is widely used in the air conditioning and refrigeration industry now and designates a heat exchanger with a plurality of parallel passages, among which refrigerant is distributed and flown in the orientation generally substantially perpendicular to the refrigerant flow direction in the inlet and outlet manifolds. This definition is well adapted within the technical community and will be used throughout the text.

Refrigerant maldistribution in refrigerant system evaporators is a well-known phenomenon. It causes significant evaporator and overall system performance degradation over a wide range of operating conditions. Maldistribution of refrigerant may occur due to differences in flow impedances within evaporator channels, non-uniform airflow distribution over external heat transfer surfaces, improper heat exchanger orientation or poor manifold and distribution system design. Maldistribution is particularly pronounced in parallel flow evaporators due to their specific design with respect to refrigerant routing to each refrigerant circuit. Attempts to eliminate or reduce the effects of this phenomenon on the performance of parallel flow evaporators have been made with little or no success. The primary reasons for such failures have generally been related to complexity and inefficiency of the proposed technique or prohibitively high cost of the solution.

In recent years, parallel flow heat exchangers, and brazed aluminum heat exchangers in particular, have received much attention and interest, not just in the automotive field but also in the heating, ventilation, air conditioning and refrigeration (HVAC&R) industry. The primary reasons for the employment of the parallel flow technology are related to its superior performance, high degree of compactness and enhanced resistance to corrosion. Parallel flow heat exchangers are now utilized in both condenser and evaporator applications for multiple products and system designs and configurations. The evaporator applications, although promising greater benefits and rewards, are more challenging and problematic. Refrigerant maldistribution is one of the primary concerns and obstacles for the implementation of this technology in the evaporator applications.

As known, refrigerant maldistribution in parallel flow heat exchangers occurs because of unequal pressure drop inside the channels and in the inlet and outlet manifolds, as well as poor manifold and distribution system design. In the manifolds, the difference in length of refrigerant paths, phase separation, gravity and turbulence are the primary factors responsible for maldistribution. Inside the heat exchanger channels, variations in the heat transfer rate, airflow distribution, manufacturing tolerances, and gravity are the dominant factors. Furthermore, the recent trend of the heat exchanger performance enhancement promoted miniaturization of its channels (so-called minichannels and microchannels), which in turn negatively impacted refrigerant distribution. Since it is extremely difficult to control all these factors, many of the previous attempts to manage refrigerant distribution, especially in parallel flow evaporators, have failed.

In the refrigerant systems utilizing parallel flow heat exchangers, the inlet and outlet manifolds or headers (these terms will be used interchangeably throughout the text) usually have a conventional cylindrical shape. When the two-phase flow enters the header, the vapor phase is usually separated from the liquid phase. Since both phases flow independently, refrigerant maldistribution tends to occur.

If the two-phase flow enters the inlet manifold at a relatively high velocity, the liquid phase (droplets of liquid) is carried by the momentum of the flow further away from the manifold entrance to the remote portion of the header. Hence, the channels closest to the manifold entrance receive predominantly the vapor phase and the channels remote from the manifold entrance receive mostly the liquid phase. If, on the other hand, the velocity of the two-phase flow entering the manifold is low, there is not enough momentum to carry the liquid phase along the header. As a result, the liquid phase enters the channels closest to the inlet and the vapor phase proceeds to the most remote ones. Also, the liquid and vapor phases in the inlet manifold can be separated by the gravity forces, causing similar maldistribution consequences. In either case, maldistribution phenomenon quickly surfaces and manifests itself in evaporator and overall system performance degradation.

Moreover, maldistribution phenomenon may cause the two-phase (zero superheat) conditions at the exit of some channels, promoting potential flooding at the compressor suction that may quickly translate into the compressor damage.

SUMMARY OF THE INVENTION

Briefly, in accordance with one aspect of the invention, the uneven distribution of refrigerant to the individual channels from the inlet manifold is overcome and compensated by providing non-uniform external heat transfer characteristics associated with the individual channels, such that the detrimental effects of refrigerant maldistribution are counter-balanced, their effect on the heat exchanger performance is minimized and potential flooding conditions at the evaporator exit are avoided.

In accordance with another aspect of the invention, the external heat transfer surface parameters such as a number, and/or type and/or size of the fins are varied among the individual channels, which will result in a variable heat transfer rate for the individual channels in such a manner as to counter-balance and compensate the refrigerant maldistribution that would otherwise manifest itself in a variety of applications.

By yet another aspect of the invention, the airflow rate over the individual channels is selectively made variable such that the variable heat transfer rate is once again obtained to offset the refrigerant maldistribution that would otherwise occur in many applications.

In the drawings as hereinafter described, preferred and alternate embodiments are depicted; however, various other modifications and alternate constructions can be made thereto without departing from the true spirit and scope of the invention.

DESCRIPTION OF THE PREFERRED EMBODIMENT

Figure 1:
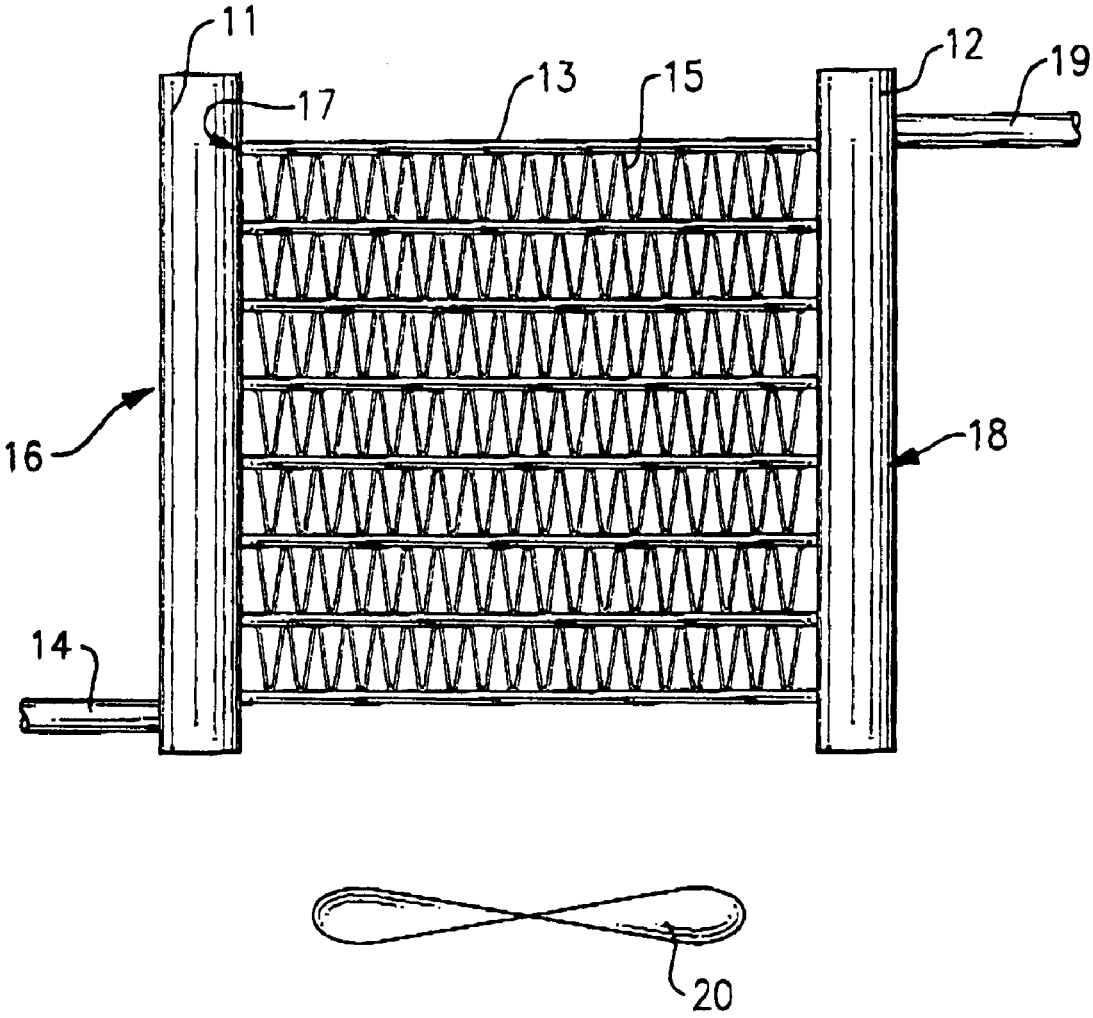
FIG.1 Prior Art
FIG. 1 is a schematic illustration of a parallel flow heat exchanger in accordance with the prior art.

Referring now to FIG. 1, a parallel flow heat exchanger is shown to include an inlet header or manifold 11, an outlet header or manifold 12 and a plurality of parallel disposed channels 13 fluidly interconnecting the inlet manifold 11 to the outlet manifold 12. Generally, the inlet and outlet headers 11 and 12 are cylindrical in shape, and the channels 13 are tubes (or extrusions) of flattened or round shape. Channels 13 normally have a plurality of internal and external heat transfer enhancement elements, such as fins. For instance, external fins 15, uniformly disposed therebetween for the enhancement of the heat exchange process and structural rigidity are typically furnace-brazed. Channels 13 may have internal heat transfer enhancements and structural elements as well.

In operation, two-phase refrigerant flows into the inlet opening 14 and into the internal cavity 16 of the inlet header 11. From the internal cavity 16, the refrigerant, in the form of a liquid, a vapor or a mixture of liquid and vapor (the most typical scenario) enters the tube openings 17 to pass through the channels 13 to the internal cavity 18 of the outlet header 12. From there, the refrigerant, which is now usually in the form of a vapor, passes out the outlet opening 19 and then to the compressor (not shown). Externally to the channels 13, air is circulated uniformly over the channels 13 and associated fins 15 by an air-moving device, such as fan 20, so that heat transfer interaction occurs between the air flowing outside the channels and refrigerant in the channels.

Since, for a particular application, the various factors that cause the maldistribution of refrigerant to the channels are generally known at the design stage, the inventors have found it feasible to introduce the design features that will counter-balance them in order to eliminate the detrimental effects on the evaporator and overall system performance as well as potential compressor flooding and damage. For instance, for a particular application it is generally known whether the refrigerant flows into the inlet manifold at a high or low velocity and how the maldistribution phenomenon is affected by the velocity values. Although, for illustrative purposes only, the present invention will be described with respect to this particular parameter, a person of ordinarily skill in the art will recognize how to apply the teachings of this invention to other system characteristics.

Figure 2A:
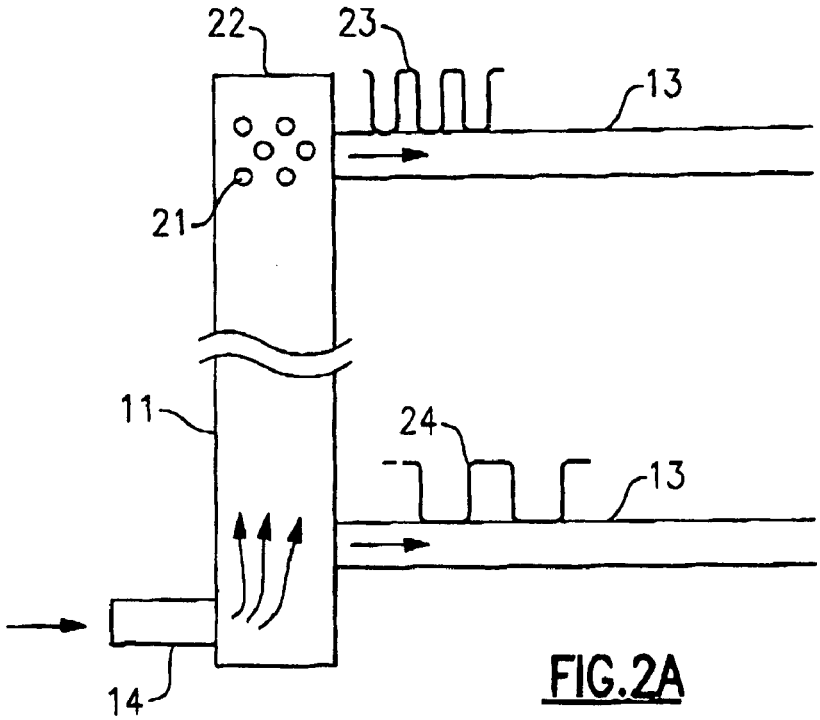
FIGS. 2A and 2B are illustrations of the design features in accordance with one embodiment of the invention.

In FIG. 2A, it is seen that the refrigerant flow in the inlet manifold 11 is at a relatively high velocity such that the liquid droplets 21 tend to proceed to the downstream end 22 of the inlet manifold 11. For that reason, unless the design changes are made, the downstream channels 13 will receive more of the liquid refrigerant and the upstream channels will receive more of the refrigerant vapor to thereby result in an unbalanced and inefficient heat exchanger performance as well as potentially flooding conditions at the evaporator exit, since there may be not enough heat transfer potential to evaporate all the liquid refrigerant in the downstream channels.

Just oppositely, as shown in FIG. 2 B, when the refrigerant flow into the in the inlet manifold 11 is at a relatively low velocity, the liquid droplets 21 will tend to remain in the upstream end 23 of the inlet manifold 11 and proceed into the nearby channels, and the downstream channels will tend to receive more vapor. Again, a decreased evaporator performance and flooding will be the likely outcomes.

In addressing the abovedescribed phenomenon, which exists within the internal confines of the inlet manifold 11 and channels 13, the inventors have found it feasible to modify the design features of the extended external surfaces of the channels 13 in order to counter-balance the non-uniform conditions within the channels 13. This can be accomplished in a number of ways, some of which will be described in detail hereinafter.

Since the pressure drop through all of the parallel paths in the evaporator is substantially equal, the channels flowing predominantly liquid refrigerant (which is at substantially higher density than vapor) receive higher refrigerant flow than the channels flowing vapor refrigerant (assuming equal external heat transfer rate for all the channels) and, as a result of such flow unbalance, performance degradation and possibly flooding conditions occur in the channels, reducing overall system performance and raising reliability concerns for the components such as a compressor.

One approach to solving the maldistribution problem is that of providing a higher external heat transfer rate (reducing external thermal resistance) by incorporating a higher density of fins, more efficient fin type (e.g. louvered fin) or altering other fin characteristics, such as fin material or height (this will reduce the distance between the channels 13 accordingly) for the channels having the higher refrigerant flow. The precautions have to be made to make sure that airflow over these channels is not appreciably altered, that may diminish the desired effect. That is, in the high velocity refrigerant flow example of FIG. 2A, for instance the density of the fins 23 associated with the downstream channels is greater than the density of the fins 24 associated with the upstream channels. Although, only two channels are shown, it is understood that there will be a plurality of channels therebetween with different fin densities such that the fin densities increase as the channels proceed toward the downstream end 22. Furthermore, to reduce manufacturing cost or for the heat exchangers with a sufficient number of channels 13, the adjacent channels can be combined in sections of an identical fin density, with the fin density increasing from one section to another in the direction of the downstream end 22 of the inlet manifold 11. In this case, each section is represented by an individual channel 13 in FIG. 2A.

Figure 2B:
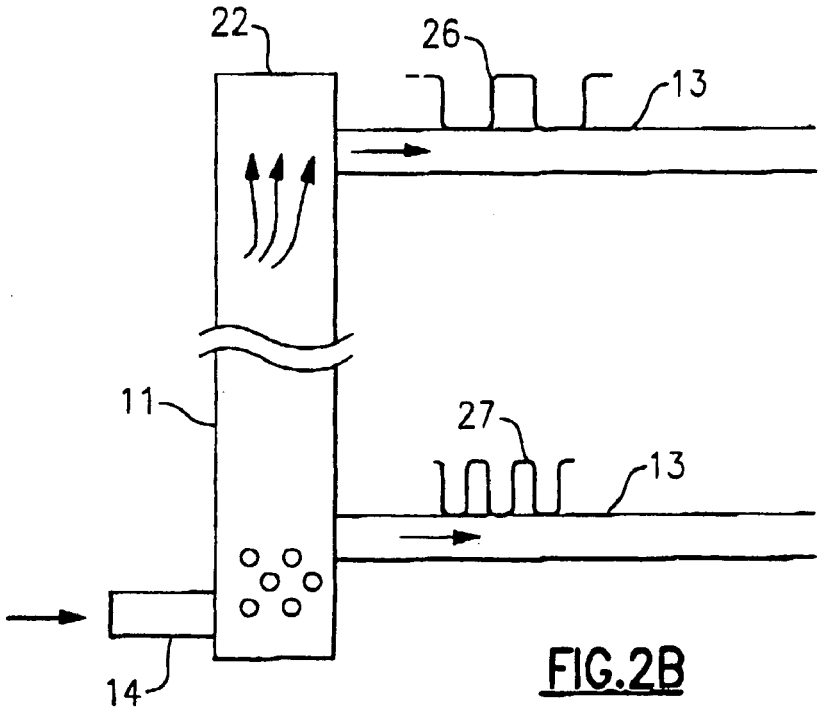

Similarly, in the example wherein the refrigerant flow velocity in the inlet manifold 11 is low, as shown in FIG. 2B, the density of the fins 26 toward the downstream end 22 of the inlet header 11 is less than the density of the fins 27 toward the upstream end of the header 11.

In operation, for those channels having a higher density of fins, the heat transfer capability will be enhanced over those having the lower density of fins, such that the refrigerant in those channels evaporates at a higher rate generating more low-density vapor, and the superheat conditions at the channel exit are assured. Consequently, the pressure drop through the channels increases, redirecting the imbalance of the refrigerant flow to the other channels and reducing maldistribution.

As it was mentioned above, rather than varying the density of the fins across the plurality of channels, the same effect can be achieved by incorporating an enhanced (e.g. louvered) fins, changing the size of the fins, altering fin thickness or providing material differences, in order to selectively vary the heat transfer rate across the channels. Also, internal elements augmenting the heat transfer rate can be applied in a similar manner to achieve similar results.

Once again, these design alterations shouldn't change airflow distribution across the channels, which may diminish the desired outcome.

Another approach to varying the heat transfer rate across the channels is to vary the flow of air over the respective channels such that those channels having the higher refrigerant flow (i.e. those having more liquid droplets and less vapor) have more air flowing over their outer surfaces than those channels having the lower refrigerant flow (i.e. those having more vapor and less liquid droplets).

An air-moving device, such as a fan, provides airflow over the external evaporator surfaces to transfer heat from air to refrigerant. Generally, an effort is made to assure that the airflow is uniform over the cross-section area of the heat exchanger. Unfortunately, for some evaporator section constructions, it becomes a difficult task. As a result, different heat transfer rates for different channels result in the same maldistribution phenomenon and flooded conditions as the ones associated with the inlet manifold and discussed above. One embodiment of this invention proposes to utilize a naturally non-uniform airflow or by simple means alter airflow to be non-uniform, in order to counter-balance the maldistribution phenomenon associated with the inlet manifold.

Figure 3A:
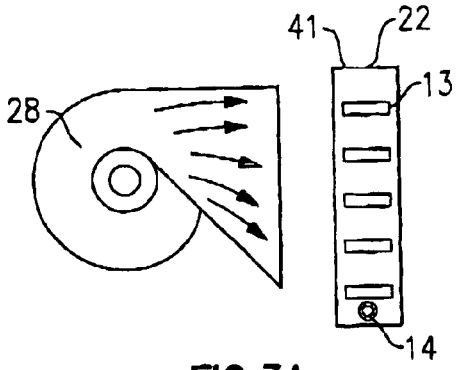
FIGS. 3A and 3B show the design features in accordance with another embodiment of the present invention.

In FIG. 3A a fan within a scroll housing 28 is shown as directing the air, as indicated by the arrows, toward the heat exchanger 41 such that the air flows across the channels 13. Assuming that the application is for a high velocity refrigerant flow into the inlet manifold, those channels more remote from the inlet 14 will have greater refrigerant flow therethrough. In order to counter-balance this phenomenon, it is therefore desirable to have higher airflow over those channels. This will occur with the arrangement as shown, since, as indicated by the arrows, the airflow associated with the channels adjacent to the downstream end 22 remote from the manifold inlet 14 has, simply saying, lower turning losses than the airflow associated with the channels adjacent to the upstream end near the manifold inlet 14. Thus, the superior external heat transfer rate will be provided to the downstream channels than to the channels near the opening 14, as desired. Obviously enough, a sufficient distance is to be provided between the scroll housing 28 and the heat exchanger 41 to obtain the desired results.

Figure 3B:
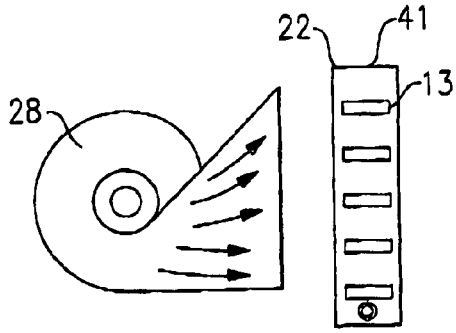

In a similar manner, the FIG. 3B illustrates the opposite treatment for an application wherein the refrigerant velocity to the inlet manifold is relatively low. Here, the fan scroll is mounted in an opposite orientation such that the greater heat transfer rate will occur at those channels nearer the opening 14 and lower heat transfer rate will occur at the more remote channels at the downstream end 22 remote from the manifold inlet 14.

Figure 4A:
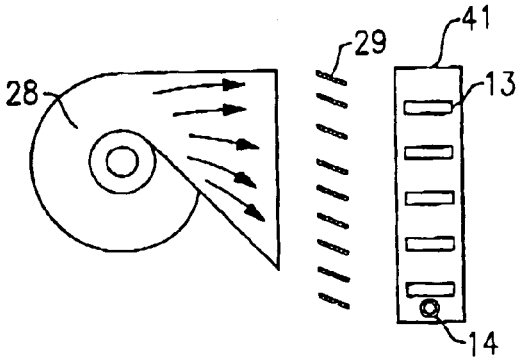
FIGS. 4A and 4B show the design features in accordance with another embodiment of the invention.
Figure 4B:
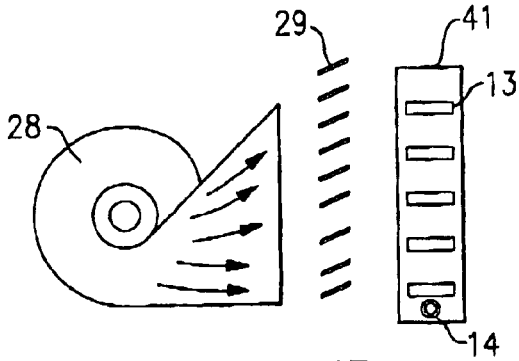

FIGS. 4A and 4B embodiments show similar arrangements but include a bank of louvers 29, which can be selectively positioned in an uniform manner so as to tune to the particular airflow pattern that will bring about the results as desired for a variety of operating conditions. In this case, a conventional fan scroll 28 can be designed and positioned using standard configuration and location, and the airflow distribution over the individual channels is controlled by the louvers 29.

Figure 5:
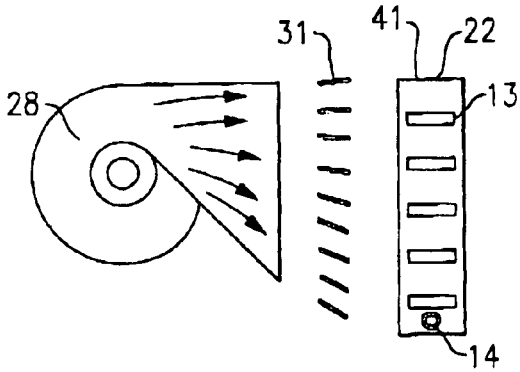
FIG. 5 shows the features in accordance with another embodiment of the invention.

In FIG. 5, an additional feature is added wherein the bank of louvers 31 are variably angled from one end to the other. Thus, as shown, the louvers nearest the channels associated with the downstream end 22 remote from the manifold inlet 14 provides little or no resistance whereas the louvers adjacent to the channels associated with the upstream end of the opening 14 are turned at a greater angle and therefore act to restrict airflow and reduce the amount of heat transfer that occurs at the channels nearest to the opening 14.

Furthermore, it should be noted that both vertical and horizontal channel orientations will benefit from the teaching of the present invention, although higher benefits will be obtained for the latter configuration. Also, although the teachings of this invention are particularly advantageous for the evaporator applications, refrigerant system condensers may benefit from them as well.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A parallel flow heat exchanger and airflow system comprising:

an inlet manifold having an inlet opening for conducting the flow of refrigerant into said inlet manifold and a plurality of outlet openings for conducting the flow of refrigerant out of said inlet manifold;

a plurality of channels aligned in substantially parallel relationship with and fluidly connected to said plurality outlet openings for conducting the flow of refrigerant from said inlet manifold, wherein said plurality of channels are susceptible to having a non-uniform distribution of two-phase refrigerant to the respective channels;

an outlet manifold fluidly connected to said plurality of channels for receiving the flow of refrigerant therefrom;

heat transfer means applied to outer surfaces of said plurality of channels so as to provide variable heat transfer rates to the external surfaces of the respective channels when air is circulated thereover, with those heat transfer rate being selected so as to counter-balance the non-uniform distribution of two-phase refrigerant to the respective channels; and wherein said heat transfer means comprises an air-moving device which is so placed and directed with respect to said heat exchanger so as to provide higher airflow over those channels with higher refrigerant flow therethrough and lower airflow over those channels with lower refrigerant flow therethrough.

2. A parallel flow heat exchanger and airflow system as set forth in claim 1, wherein said air-moving device is placed and directed to provide higher airflow over those channels downstream of said inlet opening than those channels nearer said inlet opening.

3. A parallel flow heat exchanger and airflow system as set forth in claim 1, wherein said air-moving device is disposed and directed to provide lower airflow over those channels downstream of said inlet opening than those channels nearer said inlet opening.

4. A parallel flow heat exchanger and airflow system as set forth in claim 1, wherein said air-moving device is a fan located within the scroll housing and wherein the airflow is progressively varied from one side of the scroll exit to the other, and further wherein the side with maximum airflow is disposed adjacent to those channels with higher flow of refrigerant therethrough.

5. A parallel flow heat exchanger and airflow system as set forth in claim 1 and including a plurality of louvers disposed between said air-moving device and said heat exchanger for selectively directing the air from said air-moving device over said heat exchanger.

6. A parallel flow heat exchanger and airflow system as set forth in claim 5, wherein said louvers are set at progressively increasing angles, such that the louvers with smaller angles being disposed adjacent to those channels having higher refrigerant flow therethrough.

7. A parallel flow heat exchanger and airflow system of the type having an inlet manifold fluidly interconnected to an outlet manifold by a plurality of parallel channels for conducting the flow of a first fluid therethrough and adapted for having a second fluid circulated thereover for purposes of exchange of heat between the two fluids, wherein the plurality of channels are susceptible to having a non-uniform two-phase distribution of the first fluid flowing therethrough, comprising:

an air-moving device for circulating the second fluid over the plurality of channels; and a plurality of extended surface elements disposed on an external surface of the plurality of channels, wherein said air-moving device and said plurality of extended surface elements are constructed so as to provide variable heat transfer rates to the respective channels, with those heat transfer rates being selected so as to counter-balance the non-uniform two-phase distribution of said first fluid into the respective channels; and wherein said air-moving device is placed and directed with respect to said heat exchanger to provide higher airflow over those channels with higher refrigerant flow therethrough and lower airflow over those channels with lower refrigerant flow therethrough.

8. A parallel flow heat exchanger and airflow system as set forth in claim 7, wherein said air-moving device is placed and directed to provide higher airflow over those channels downstream of said inlet opening than those channels nearer said inlet opening.

9. A parallel flow heat exchanger and airflow system as set forth in claim 7, wherein said air-moving device is disposed and directed to provide lower air to flow over those channels downstream of said inlet opening than those channels nearer said inlet opening.

10. A parallel flow heat exchanger and airflow system as set forth in claim 7, wherein said air-moving device is a fan located within the scroll housing and wherein the airflow is progressively varied from one side of the scroll exit to the other, and further wherein the side with maximum airflow is disposed adjacent to those channels with higher flow of refrigerant therethrough.

11. A parallel flow heat exchanger and airflow system as set forth in claim 7 and including a plurality of louvers disposed between said air-moving device and said heat exchanger for selectively directing the air from said air-moving device over said heat exchanger.

12. A parallel flow heat exchanger and airflow system as set forth in claim 10, wherein said louvers are set at progressively increasing angles, such that the louvers with smaller angles being disposed adjacent to those channels having higher refrigerant flow therethrough.

13. A method of promoting uniform refrigerant flow in a parallel flow heat exchanger of the type having an inlet manifold fluidly interconnected to an outlet manifold by a plurality of parallel channels for conducting the flow of the first fluid therethrough and adapted for having a second fluid circulated thereover for purposes of exchange of heat between the two fluids, wherein the plurality of channels are susceptible to having a non-uniform two-phase distribution of the first fluid flowing therethrouuh comprising the steps of:

providing an air-moving device for circulating the second fluid over the plurality of channels;

providing a plurality of extended surface elements disposed on an external surface of the plurality of channels:

wherein said air-moving device and said plurality of extended surface elements are constructed so as to provide variable heat transfer rates to respective channels, with those heat transfer rates being selected so as to counter-balance the non-uniform two-phase distribution of the first fluid into the respective channels; and wherein said air-moving device which is placed and directed with respect to said heat exchanger to provide higher airflow over those channels with higher flow of the first fluid therethrough and lower airflow over those channels with lower flow of the first fluid therethrough.

14. A method as set forth in claim 13, wherein said air-moving device is placed and directed to provide higher airflow over those channels downstream of said inlet opening than those channels nearer said inlet opening.

15. A method as set forth in claim 13, wherein said air-moving device is placed and directed to provide lower airflow over those channels downstream of said inlet opening than those channels nearer said inlet opening.

16. A method as set forth in claim 13, wherein said air-moving device is a fan located within the scroll housing and wherein the airflow is progressively varied from one side of the scroll exit to the other, and further wherein the side with maximum airflow is disposed adjacent to those channels with higher flow of the first fluid therethrough.

17. A method as set forth in claim 13 and including a plurality of louvers disposed between said air-moving device and said heat exchanger for selectively directing the air from said fan over said heat exchanger.

18. A method as set forth in claim 17, wherein said louvers are set at progressively increasing angles, such that the louvers with smaller angles being disposed adjacent to those channels having higher flow of the first fluid therethrough.

* * * * *